US006745915B2

(12) United States Patent
Rees

(10) Patent No.: US 6,745,915 B2
(45) Date of Patent: Jun. 8, 2004

(54) DRINKING VESSEL HAVING A MOUTHPIECE WITH A FLEXIBLE PORTION

(75) Inventor: Arnold Edward Rees, Newcastle Upon Tyne (GB)

(73) Assignee: Jackel International Limited, Northumberland (GB)

( * ) Notice: Subject to any disclaimer, the term of this patent is extended or adjusted under 35 U.S.C. 154(b) by 0 days.

(21) Appl. No.: 09/929,514

(22) Filed: Aug. 14, 2001

(65) Prior Publication Data

US 2002/0066741 A1 Jun. 6, 2002

Related U.S. Application Data

(63) Continuation of application No. PCT/GB00/00479, filed on Feb. 14, 2000.

(30) Foreign Application Priority Data

Feb. 16, 1999 (GB) ..... 9903554

(51) Int. Cl.[7] ..... A47G 19/22

(52) U.S. Cl. ..... 220/714; 222/717; 222/705; 215/11.4; 215/387; 215/389

(58) Field of Search ..... 215/387–389, 215/11.1, 11.4; 220/203.01, 203.04, 203.09, 203.11, 203.19, 703, 705, 711, 714, 716, 717, 254.1, 255

(56) References Cited

U.S. PATENT DOCUMENTS 1,569,693 A * 1/1926 Young ..... 215/11.4
2,584,359 A * 2/1952 Miles ..... 215/11.4
4,586,621 A * 5/1986 Dahan ..... 215/11.1
4,782,975 A * 11/1988 Coy ..... 220/711
4,828,141 A * 5/1989 Coy ..... 220/380
5,050,758 A * 9/1991 Freeman et al. ..... 220/714
5,186,347 A * 2/1993 Freeman et al. ..... 220/254.1
5,366,109 A * 11/1994 Proshan ..... 220/717
5,607,073 A * 3/1997 Forrer ..... 215/11.4
5,747,083 A * 5/1998 Raymond et al. ..... 426/117
5,893,472 A * 4/1999 Forrer ..... 215/11.4
6,102,245 A * 8/2000 Haberman ..... 220/714
6,112,919 A * 9/2000 Ho ..... 215/11.4
6,116,457 A * 9/2000 Haberman ..... 220/703
6,230,923 B1 * 5/2001 Hung ..... 220/703
6,305,570 B1 * 10/2001 Atkin et al. ..... 220/714
2002/0158075 A1 * 10/2002 Caldicott et al. ..... 220/714

FOREIGN PATENT DOCUMENTS

EP 0 838 184 A1 4/1998

* cited by examiner

*Primary Examiner*—Robin A. Hylton
(74) *Attorney, Agent, or Firm*—Osha & May L.L.P.

(57) ABSTRACT

A drinking vessel includes a cover and a mouthpiece, the mouthpiece having at least a flexible portion which in its unflexed state engages a plug extending up through the mouthpiece. When the flexible portion is flexed, for example by suction or pressing or biting with lips or teeth the flexible portion flexes out of engagement with the plug, forming a liquid passage. As a result a self-sealing drinking vessel is provided which provides liquid on user demand.

11 Claims, 7 Drawing Sheets

DRINKING VESSEL HAVING A MOUTHPIECE WITH A FLEXIBLE PORTION

CROSS REFERENCE TO RELATED APPLICATIONS

The application is a continuation of PCT/GB00/00479, filed Feb. 4, 2000.

FIELD OF THE INVENTION

The invention relates to a drinking vessel, and in particular a drinking vessel such as an infant cup.

BACKGROUND OF THE INVENTION

A range of infant cups are known, for example of the type generally termed trainer cups, including a cup-like body often including handles for ease of use by a infant, a cover and a drinking spout provided on the cover. The spout can be rigid or flexible. The cup is easier to handle and allows the infant to drink from the cup with less risk of spillage.

Various improvements to infant cups are known. For example U.S. Pat. No. 5,186,347 and GB 2304545 relate to trainer cups including a slit valve membrane fixed at the tip of the spout, which allows liquid to flow when the infant sucks but closes otherwise. As a result the cup is largely spill-proof under normal conditions.

Problems exist with the known arrangements, however. The moulding and fitting of the membranes may be a complex and costly, operation, residue may be trapped where the membrane and spout meet, and because of the typically small orifice at the spout the membrane may be difficult to clean. In addition, the child is often required to suck very hard to open slit valve membranes of this type which can be tiring and offputting for the child. The slit valves are very fragile and can be easily damaged, a particular risk in view of the use of the cup by a child, and the likelihood that a child will be left unattended with it because of its spillproof nature.

Yet further, as liquid is removed from the known cups, a negative pressure may develop in the cup which may make further drinking yet harder and removal of the lid equally difficult. It is difficult to open the valve manually to overcome this problem without damaging it.

A particular problem with valves of the known type arises when fruit juices are drunk from the vessel—in this case the fibres can clog the slit and prevent it from sealing properly, which can give rise to leakage.

The invention is set out in the appended claims.

Embodiments of the invention will now be described, by way of example, with reference to the drawings, of which:

DETAILED DESCRIPTION

Figure 1:
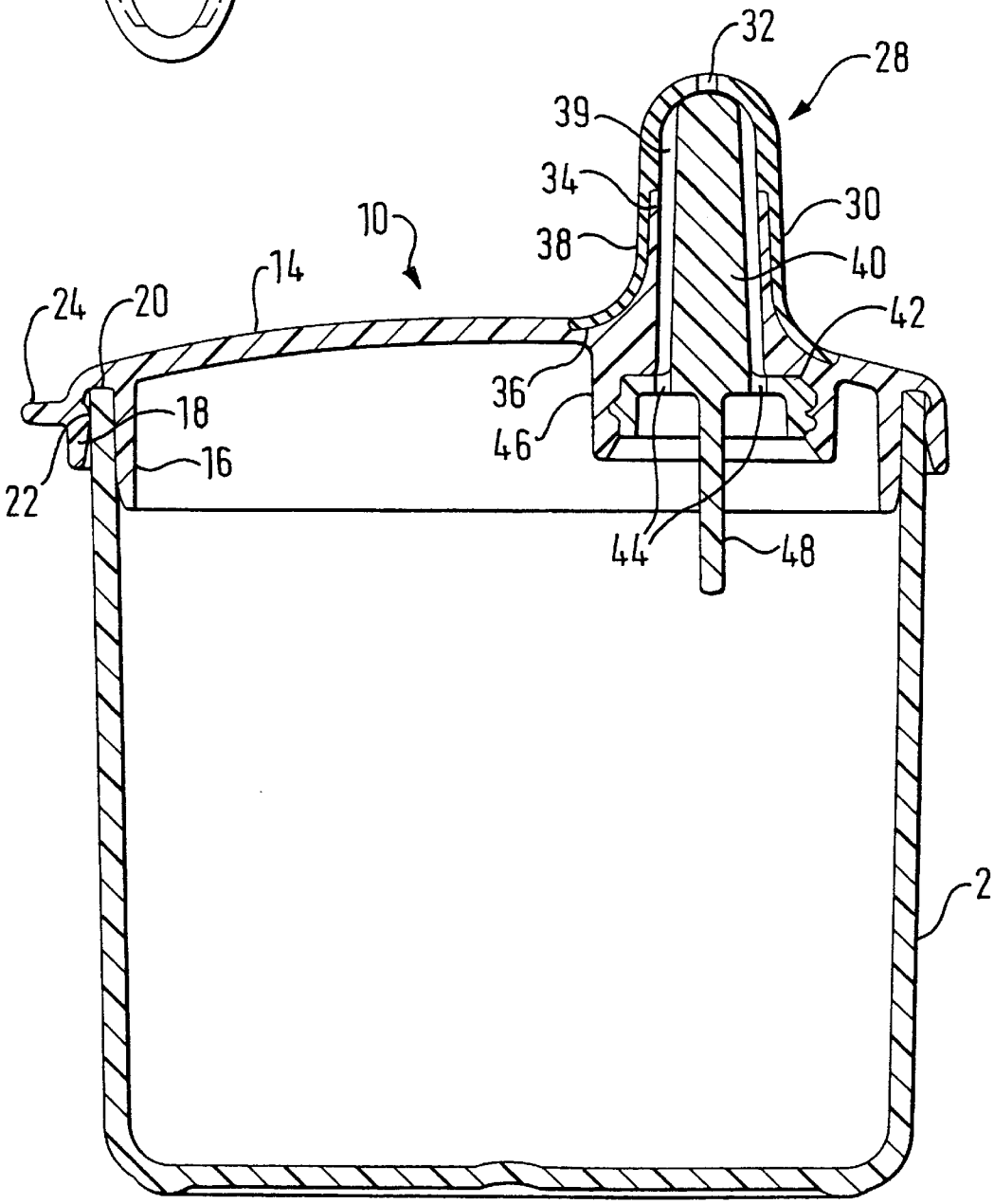
FIG. 1 shows a drinking vessel according to one embodiment of the present invention with the spout in the closed position.

FIG. 1 shows the basic components of the drinking vessel of the present invention, generally designated 10. The vessel 10 includes a vessel body, having a base and sidewall usually of a cup configuration and circular in cross section, 12, and a cover 14. The cover 14 includes inner and outer downwardly projecting skirts 16, 18 at its periphery defining an annular groove 20 between them which receives the top of the sidewall of the vessel body 12. The inner and outer skirts 16, 18 are preferably slightly resilient and form a friction fit with the vessel body 12. The liquid seal thus formed can be enhanced by a bead 22 or other sealing projection on the inner face of the outer skirt 18. The cover 14 may include a tab 24 projecting from the outer skirt 18, to aid in removing the cover 14. Alternatively the cover 14 could be a screw-fit. The vessel body 12 and cover 14 are formed of any suitable material, for example Polypropylene.

The cover 14 include a mouthpiece 28 comprising a mouthpiece sheath 30 in the form of a flexible element having at its top a liquid outlet orifice 32. As can be seen from FIG. 2 the mouthpiece is roughly oval in cross section, with the long axis transverse to a radius of the cover 14. The positioning and shape of the mouthpiece 28 can follow the conventional configurations well known to the skilled person. The flexible material forming the mouthpiece sheath 30 is preferably EVOPRENE (a trademark) but any suitable thermoplastic elastomer can be used as long as it is flexible enough for the user, for example an infant, to flex the material by suction and/or the pressure of the user's lips or teeth when drinking from the mouthpiece 28, as discussed in more detail below.

For ease of mounting and attaching the mouthpiece sheath 30 to the cover 14, the cover includes an upwardly projecting wall 34 onto which the sheath 30 is bonded in a suitable manner for example by the known technique of two-shot or co-molding. The cover 14 include a recessed portion 36 such that the sheath 30 is mounted flush with the top surface of the cover 14. Similarly the sheath 30 includes a reduced diameter portion for receiving the upwardly projecting wall 34 flush, such that no apertures or irregularities are present that could trap residue. The wall 34 extends roughly halfway up the sheath 30 and is substantially rigid such that the sheath only flexes appreciably at its upper region.

The upwardly projecting wall 34 of the cover 14 defines a liquid passage 39 from the inside of the vessel 10, via the orifice 32, to the user. A substantially rigid plug, or sealing element 40 having generally circular symmetry is provided in the liquid passage 39, and is of smaller diameter, providing a liquid path around its sides. As discussed in more detail below the plug 40 includes apertures 44 allowing liquid to enter the liquid passage 39 from the inside of the vessel 10. The plug 40 is of sufficient height that its top abuts the top inner surface of the mouthpiece sheath 30 when the sheath is in a relaxed, unflexed state. At least the top of the plug 40 is of greater diameter than the outlet orifice 32 in the sheath 30, such that in this state, as shown in FIG. 1, the mouthpiece 28 is sealed closed. Because the seal relies on the resilience of the sheath 30, it is correspondingly strong, and will not leak, for example, simply because fruit fibres are trapped between the plug and the sheath. The effectiveness of the seal is further enhanced because of the comparatively larger diameter of the plug relative to the orifice. In addition the arrangement is sturdy and not easily susceptible to damage and is simple to manufacture and construct.

Figure 2:
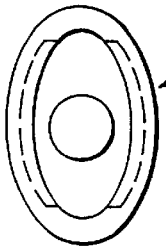
FIG. 2 is a plan view of the spout in the closed position.

The plug 40 is preferably removably mounted in the cover 14 for ease of cleaning. As shown in FIGS. 1 and 2 the plug 40 includes an upper, cylindrical portion the top of which seals against the sheath 30, and an annular flange 42 at its lower end having apertures 44 through it allowing passage of liquid from the vessel and an externally threaded cylindrical skirt 44 depending from it. The cover 14 includes an internally threaded downwardly projecting wall 46 into which the plug 40 is screwed. The plug 40 further includes a post 48 projecting beyond the wall 46 of the cover, allowing it to be screwed and unscrewed manually with minimum difficulty. As a result, the vessel can be quickly and easily entirely disassembled for thorough cleaning. In addition, the mechanical advantage of the screw-in arrangement ensures that the plug is repeatably positioned bearing suitably strongly against the sheath 30 to provide a good seal. The plug may be formed of any suitable rigid and hygienic material; in the preferred arrangement the selected material is Polycarbonate, which can be accurately molded and retains its shape.

Figure 4:
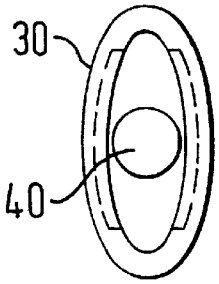
FIG. 4 is a plan view of the spout in the open position.
Figure 3:
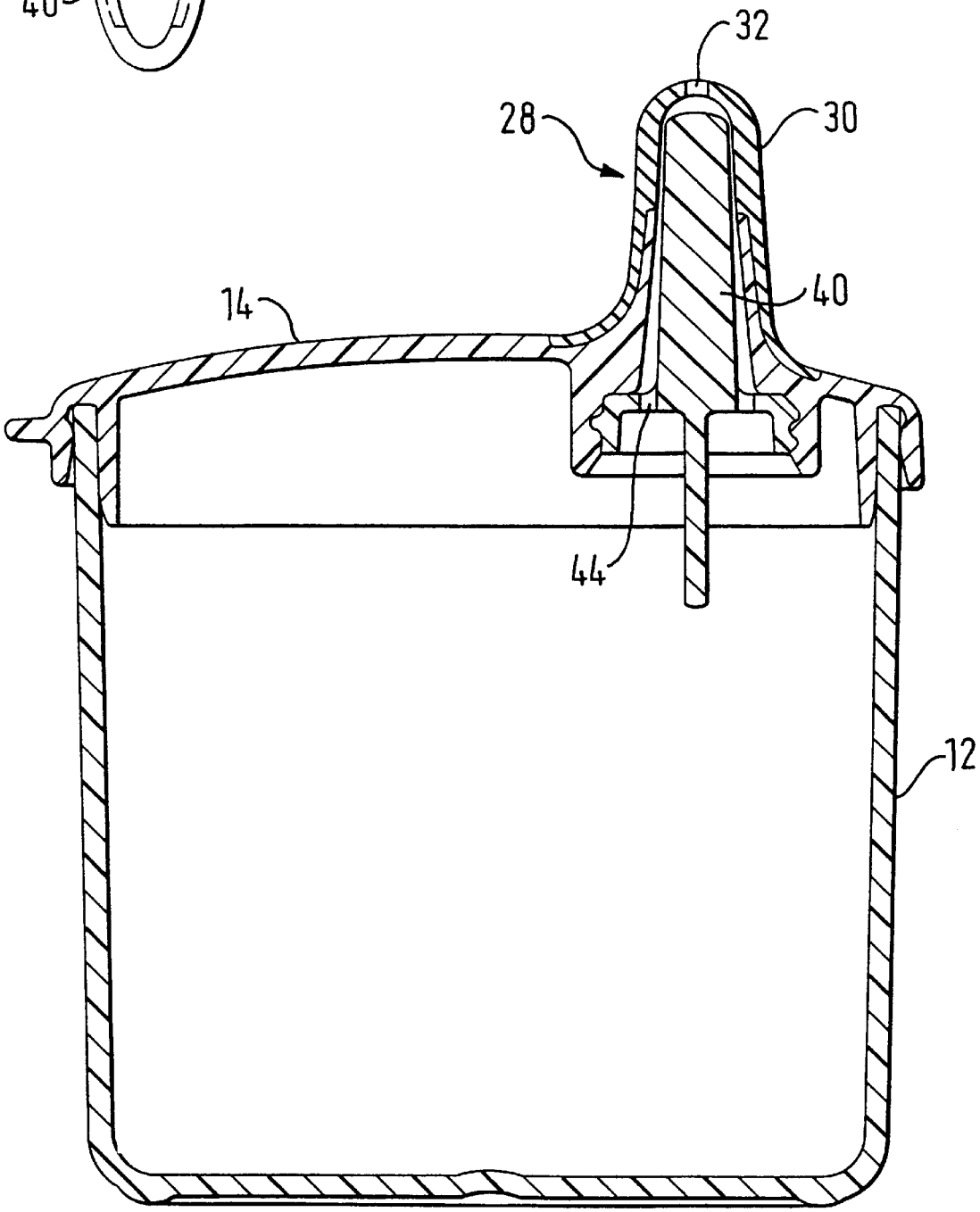
FIG. 3 shows the drinking vessel of FIG. 1 with the spout in an open position.

Operation of the invention can be understood with reference to FIGS. 3 and 4. When the user drinks through the mouthpiece 28, pressure is applied to the side walls of the flexible sheath 30, both by the users lips, and the suction applied in drinking from a spout. The sheath 30 is caused to flex upwardly and hence out of contact with the plug. As a result a liquid path from the vessel, through the apertures 44 and the space between the plug 40 and the sheath 30 (best seen in FIG. 4), and finally through the outlet orifice 32 in the sheath to the user is created. The mouthpiece thus effectively provides a valve which is opened on demand by the user, but otherwise remains spillproof. The valve can alternatively be opened on lip pressure alone. Because its operation relies on the pressure exerted on the side walls of the sheath flexing the top wall away from the plug, the strong seal created in the relaxed position can nonetheless be easily overcome by the user when he or she desires to drink. In addition the sheath is easily manually manipulable to open it, for example, to release negative pressure which may have developed in the vessel.

Figure 5A:
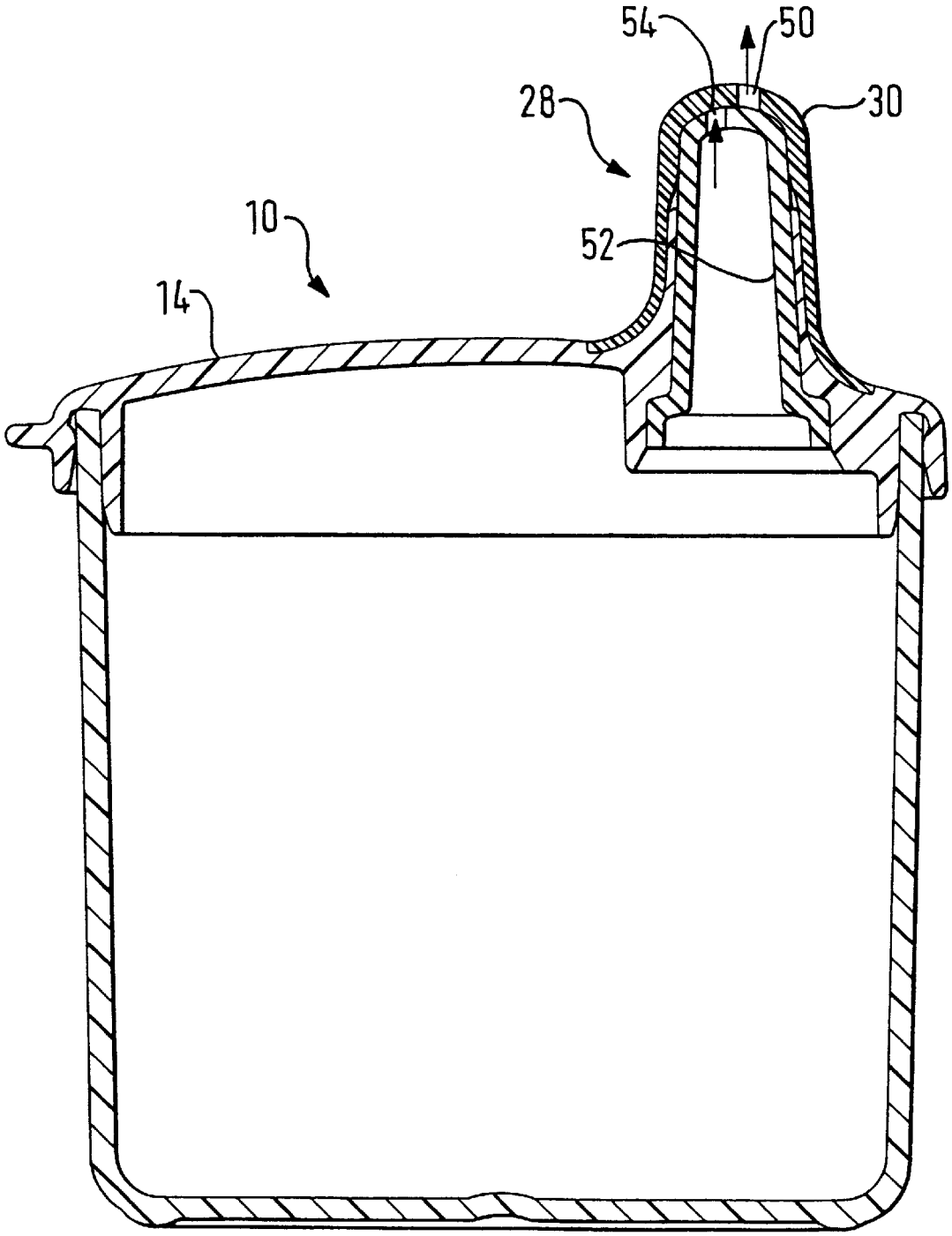
FIGS. 5*a* and 5*b* show an alternative embodiment of the drinking vessel in closed and open positions.
Figure 6:
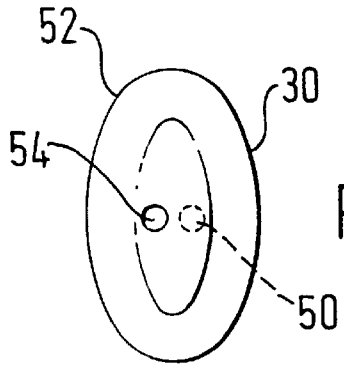
FIG. 6 is a schematic plan view of the spout of the first alternative embodiment.
Figure 5B:
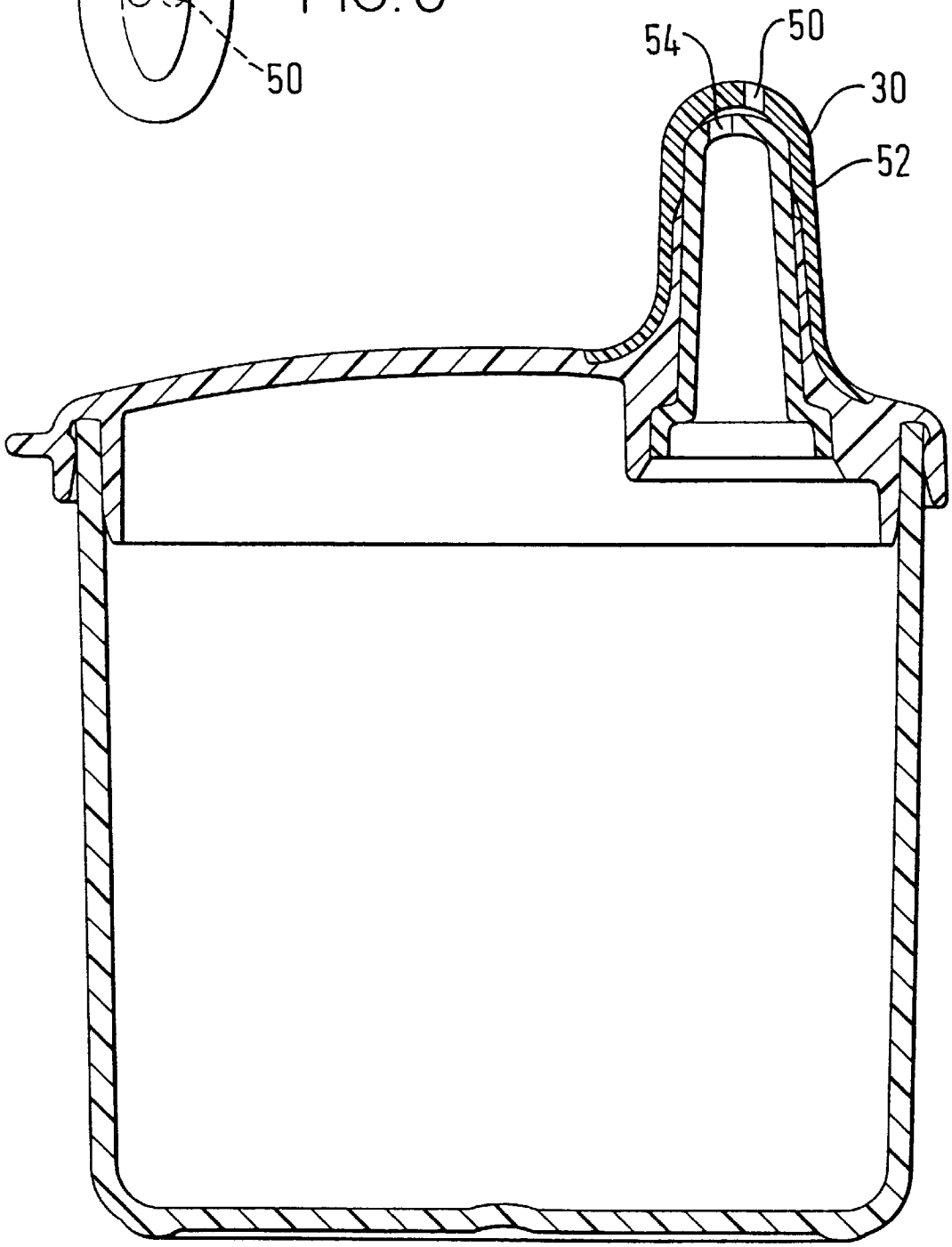

FIGS. 5 and 6 show an alternative preferred arrangement. The basic configuration is the same as that discussed above as reflected by like reference numerals as appropriate. However the outlet orifice 50 in the sheath 30 is provided off-centre. The configuration of the plug 52 also differs; it comprises a hollow rigid element with an open lower end and an upper end configured to mate with the inner surface of the sheath 30 and having an orifice 54. The plug orifice 54 is also off-centre and offset from the sheath outlet orifice 50, as can be seen from FIG. 6. When the sheath 30 is in its relaxed state, it seals against the top of the plug 52, and as the orifices are offset, the valve is closed. When suction is applied the sheath 30 flexes away from the plug 52, creating a space between them and hence a liquid communication path between the respective orifices, opening the valve. The plug 52 is a press fit into a corresponding aperture in the cover 14 to allow cleaning. Whilst this embodiment solves various problems with the prior art, it operates on suction only because of the mating fit between the plug and the sheath and hence more effort may be required than for the preferred embodiment discussed in relation to FIGS. 1 to 4. In addition, because the plug is a press-fit, the seal may be less reliable.

Figure 7A:
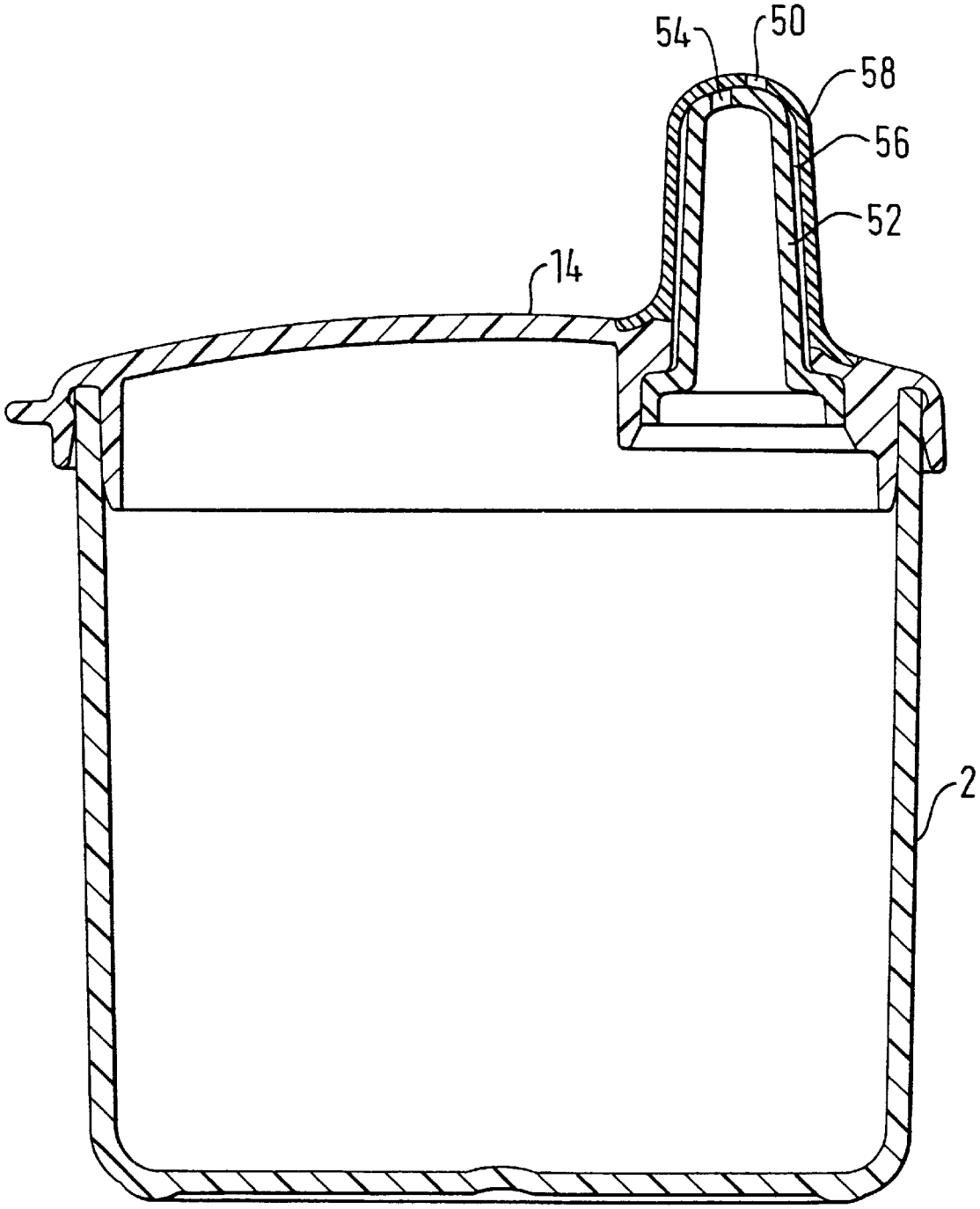
FIGS. 7*a* and 7*b* show an alternative embodiment of the drinking vessel in closed and open positions.
Figure 7B:
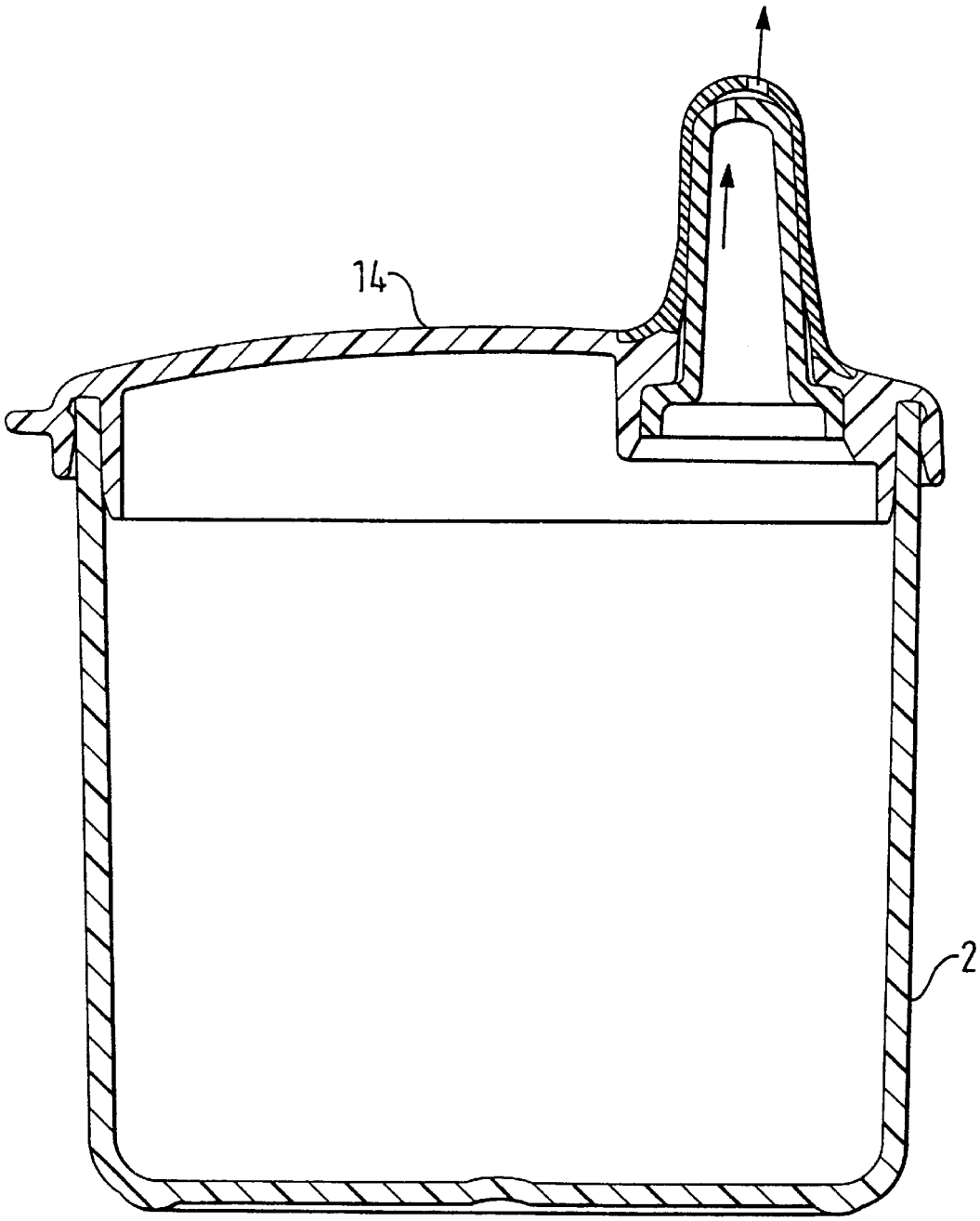
Figure 8A:
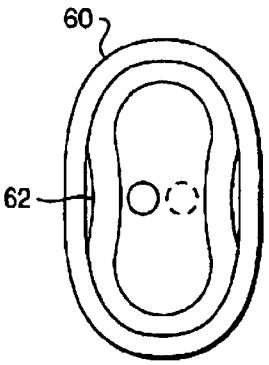
FIGS. 8*a* and 8*b* are schematic plan views of a first spout configuration for the second alternative embodiment in the closed and open positions.
Figure 8B:
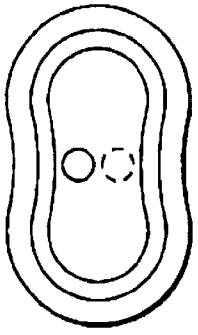
Figure 9A:
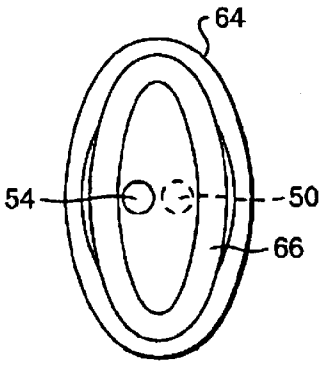
FIGS. 9*a* and 9*b* are schematic plan views of a second spout configuration for the second alternative embodiment in the closed and open positions.
Figure 9B:
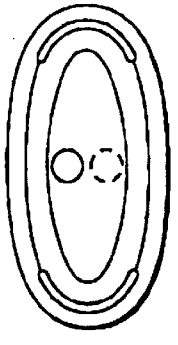

Yet a further preferred embodiment is shown in FIGS. 7 to 9. This comprises a variant of the embodiment discussed in relation to FIGS. 5 and 6, the principal difference lying in the shape of the mouthpiece sheath 56 which is not a mating fit with the plug 52; instead a gap 58 is formed between their respective sides. The sheath 56 still seals at its top against the plug 52 in the relaxed state with the orifices 50, 54 offset, but the seal is broken by the user squeezing the sheath 56 with his or her lips and sucking, flexing the end of the sheath out of engagement with the plug 52 to allow liquid flow. As can be seen from FIGS. 8 and 9 various shapes of mouthpiece sheath and plug cross-section are contemplated including an oval shaped sheath 60 around a plug 62 having a waist portion allowing compression of the sheath, (FIGS. 8*a*, 8*b*) and both components oval and having matching lengths along the long axis, but the length of the sheath 64 being greater than that of the plug 66 along the short axis allowing compression of the sheath (FIGS. 9*a*, 9*b*).

Figure 10A:
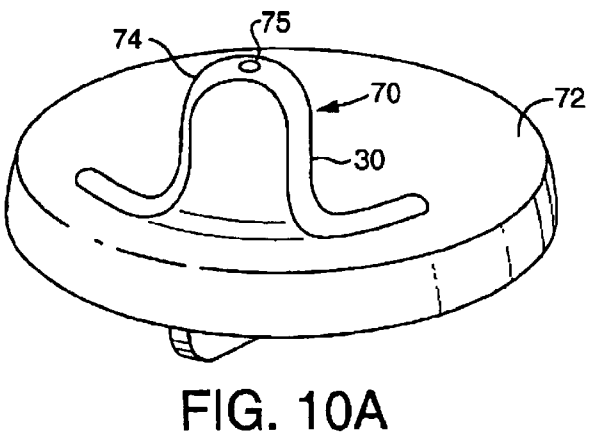
FIGS. 10*a, b* and *c* are respectively a perspective side and top view of a further embodiment.
Figure 10B:
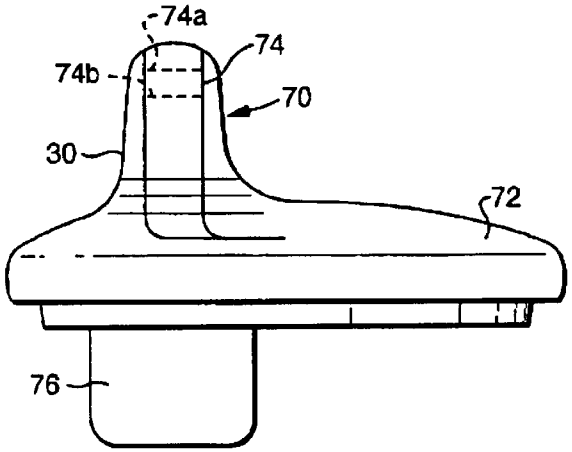
Figure 10C:
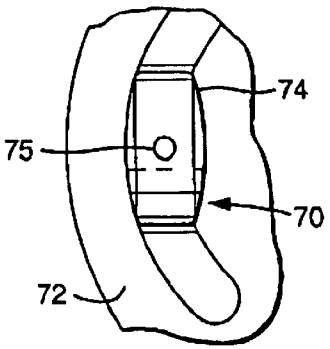

In yet a further embodiment shown in FIGS. 10*a* to 10*c* the mouthpiece sheath 70 is formed generally of rigid material, for example by moulding it integrally with the remainder of the cover 72. As in the previous embodiments the mouthpiece 70 is roughly tombstone shaped projecting from the cover 72 and oriented perpendicular to a radius of the cover 72. In this embodiment a strip 74 of flexible material, for example formed of a thermoplastic elastomer, including a drinking aperture 75 runs over the top and along the narrow sides of the mouthpiece 70 and may be moulded or adhered in place in any suitable manner. This strip of flexible material 74 fulfils the same function as the flexible sheath in other embodiments, that is to say, in its unflexed state it engages a plug (not shown) to close a liquid passage. However either when suction (negative pressure) is applied or when pressure, for example tooth pressure, is applied to the rigid sides of the mouthpiece 70 the flexible strip 74 flexes out of engagement with the plug, creating a liquid passage, again providing an automatically sealing and opening drinking vessel. It will be noted from FIG. 10*b* that an elongate plate 76 extends down from the plug allowing ease of unscrewing.

The strip 74 can be of any suitable width to provide the required degree of flexibility. In addition it can be provided only along the top as shown at 74*a* and/or partially down the sides of the mouthpiece as shown at 74*b* providing a squeeze-operated "sports cap".

As a result of these last alternative arrangements of FIG. 10, the moulding process can be simplified, the amount of flexible material reduced and an arrangement suitable for adult use, "sports use", or non-suction based use provided. In addition, infants' tendency to bite the mouthpiece is dealt with as the rigid parts of the mouthpiece will protect it.

It will be appreciated that features of the embodiments can be combined or interchanged as appropriate. It will further be appreciated that other users than infants can use the vessel and that the configuration of the vessel body and cover may be varied appropriately, for example to conform to a "sports drink" without affecting the operation of the mouthpiece which in that case can act as a "sports cap".

What is claimed is:

1. A drinking vessel comprising a vessel body, and a cover having a mouthpiece, the mouthpiece comprising a flexible strip having side portions and an end portion wherein an outlet aperture of the strip is disposed in the end portion, the vessel further comprising a seal element against which the strip seals to close the outlet aperture in a relaxed condition, the strip being adapted to disengage the seal element to open the outlet aperture in a flexed condition, wherein the mouthpiece further comprises rigid support parts between which the flexible strip is provided and that the flexible strip flexes into said flexed condition when pressure is applied to said rigid support parts.

2. A vessel as claimed in claim 1 in which positive pressure is applied to the side portions of the strip to open the outlet aperture in the flexed condition.

3. A vessel as claimed in claim 1 in which negative pressure is applied to the strip to open the outlet aperture in the flexed condition.

4. A vessel as claimed in claim 1 in which the mouthpiece defines a liquid passage, the seal element being provided in the liquid passage for liquid flow around the seal element in the flexed condition.

5. A vessel as claimed in claim 1 in which the seal element defines a liquid passage for liquid flow through the seal element in the flexed condition.

6. A vessel as claimed in claim 1 in which the seal element is removably mounted in the cover.

7. A vessel as claimed in claim 6 in which the seal element is screwed into the cover.

8. A vessel as claimed in claim 1 in which the flexible strip runs between the rigid portions substantially from the level of the cover.

9. A vessel as claimed in claim 5 in which the flexible strip is provided only in the region of the top of the mouthpiece.

10. A cover for a drinking vessel having a mouthpiece, the mouthpiece comprising:

a flexible strip having side portions and an end portion wherein an outlet aperture of the strip is disposed in the end portion, the strip being adapted to disengage a seal element to open the outlet aperture in a flexed condition; and wherein the mouthpiece further comprises rigid support parts between which the flexible strip is provided and that the flexible strip flexes into said flexed condition when pressure is applied to said rigid support parts.

11. A drinking vessel comprising a vessel body, and a cover having an upstanding mouthpiece, the mouthpiece comprising a flexible strip having side portions and an end portion, wherein an outlet aperture of the strip is disposed in the end portion, the vessel further comprising a seal element against which the strip seals to close the outlet aperture in a relaxed condition, the strip being adapted to disengage the seal element to open the outlet aperture in a flexed condition, wherein the mouthpiece further comprises rigid support parts between which the flexible strip is provided and that the flexible strip flexes into said flexed condition when pressure is applied to said rigid support parts, and wherein the strip is connected between the rigid support parts substantially parallel to a cover level and is located on an outside surface of the end portion and side portions of the mouthpiece.

* * * * *